US007699254B2

(12) United States Patent
Frangenberg et al.

(10) Patent No.: US 7,699,254 B2
(45) Date of Patent: Apr. 20, 2010

(54) TWIN-ROLL MACHINE, IN PARTICULAR FOR MATERIAL, BED MILLING

(75) Inventors: Meinhard Frangenberg, Kürten-Engeldorf (DE); Christian Splinter, Pulheim (DE); Alexander Hagedorn, Pulheim (DE)

(73) Assignee: KHD Humboldt Wedag GmbH, Cologne (DE)

( * ) Notice: Subject to any disclaimer, the term of this patent is extended or adjusted under 35 U.S.C. 154(b) by 109 days.

(21) Appl. No.: 11/816,051

(22) PCT Filed: Feb. 7, 2006

(86) PCT No.: PCT/EP2006/001038

§ 371 (c)(1),
(2), (4) Date: Nov. 6, 2007

(87) PCT Pub. No.: WO2006/084652

PCT Pub. Date: Aug. 17, 2006

(65) Prior Publication Data

US 2008/0149749 A1 Jun. 26, 2008

(30) Foreign Application Priority Data

Feb. 10, 2005 (DE) ..... 10 2005 006 090

(51) Int. Cl.
*B02C 4/32* (2006.01)

(52) U.S. Cl. ..... 241/231

(58) Field of Classification Search ..... 241/230–234
See application file for complete search history.

(56) References Cited

FOREIGN PATENT DOCUMENTS

| | | |
|---|---|---|
| JP | 09192519 | 7/1997 |
| WO | WO 9313857 | 7/1993 |

*Primary Examiner*—Mark Rosenbaum
(74) *Attorney, Agent, or Firm*—Greer Burns Crain, Ltd

(57) ABSTRACT

In the design of a twin-roller machine, such as a roll press for comminuting a bed of granular material, with two rotatably mounted, counter rotationally driven rollers which are separated from each other by a roller nip, and which use hydraulic cylinders to provide a roller pressing force the hydraulic cylinders are arranged in such a manner that they act in each case both on the bearing housings of one roller and on the respectively opposite bearing housings of the other roller with a self-contained system of milling pressing forces being formed without a closed machine frame loaded by the roller pressing forces.

20 Claims, 4 Drawing Sheets

TWIN-ROLL MACHINE, IN PARTICULAR FOR MATERIAL, BED MILLING

BACKGROUND OF THE INVENTION

The invention relates to a twin-roller machine for the pressure treatment of granular material, in particular a roll press for comminuting a bed of material or compacting or briquetting it, with two rotatably mounted, counterrotationally driven rollers which are separated from each other by a roller nip and of which at least one is designed as a loose roller moveable transversely with respect to the roller nip, the bottom and top sides of the bearing housings being mounted on slideways of machine consoles, with hydraulic cylinders being used for pressing one roller against the opposite roller.

In the case of roller mills for carrying out the "comminuting of a bed of material," the individual pieces or particles of the material to be milled, such as, for example, cement raw material, cement clinker, ores or the like, which material is drawn into the roller nip by friction, are pressed in a bed of material, i.e. in a charge of material compressed between the two roller surfaces, when a high pressure is applied, and are mutually comminuted, with a roll press also being possible instead of a roller mill. In the case of previously known roll presses, for example DE 100 18 271 A1, one of the two rollers is designed as a fixed roller which is supported directly against a side part of the machine frame while the other roller as a loose roller is supported on hydraulic cylinders with which the roller contact pressure is applied. In this case, the hydraulic cylinders which press onto the bearing housings of the loose roller have to be supported on solid side parts of the machine frame. The machine frame forms a self-contained system of forces, i.e. the high radial roller pressing forces or milling forces occurring during operation of the roll press have to be absorbed by the self-contained machine frame, which is heavy and expensive as a result. Added to this is the fact that the operators of such roll presses for comminuting a bed of material need to be able to remove and re-install the rollers in as simple and rapid a manner as possible for repair purposes etc., for which purpose the heavy machine frame would have to be dismantled and/or swung apart in order to make the rollers accessible to replace them.

SUMMARY OF THE INVENTION

The invention is based on the object of designing a twin-roller machine, in particular roll press of the abovementioned type, in such a manner that the machine frame is simple and lightweight to construct and permits a simple installation and removal of the rollers.

In the case of the twin-roller machine according to the invention, in particular a roll press for comminuting a bed of material, the hydraulic cylinders which are used to apply the roller pressing force for the compressive loading of the material which is situated in the roller nip and is to be comminuted are not supported on a heavy machine frame but rather the hydraulic cylinders are arranged in such a manner that they act in each case both on the bearing housings of one roller and on the respectively opposite bearing housings of the other roller with a self-contained system of milling pressing forces being formed, so that a closed machine frame loaded by the roller pressing forces becomes unnecessary. That is therefore to say that the radial milling forces are absorbed directly via the respectively opposite bearing housings, which are connected to each other, of the two rollers. In this case, according to a first variant of the invention, the hydraulic cylinders are arranged transversely with respect to the roller nip between the respectively mutually opposite bearing housings of the rollers, to be precise as pulling cylinders which pull the opposite bearing housings and therefore the two milling rollers together. In the case of this solution, the hydraulic pulling cylinders together with the bearing housings form a self-contained system of forces which renders a heavy machine frame superfluous. The machine frame requirement is met essentially by machine consoles with slideways on which the bottom and top sides of the bearing housings are supported in a slideable manner and which are capable of absorbing axial forces occurring during operation of the rollers.

According to a second variant of the invention, instead of pulling cylinders the hydraulic cylinders may also be pressure cylinders which can be pressed against the bearing housings of one roller, on the outer sides thereof that face away from the roller nip, and which transmit their pressing forces via connecting rods, which are situated transversely with respect to the roller nip, to the respectively opposite bearing housings of the other roller. In the case of this solution, the hydraulic pressure cylinders and the bearing housings together with the connecting rods again form the self-contained system of forces for absorbing the radial milling forces.

The twin-roller machine according to the invention is in principle in any case open towards the side. Deflecting movements of the loose roller or of the loose rollers that are necessary in the event of an overload are not obstructed. Since heavy end pieces of the machine frame are omitted, the rollers can be replaced, i.e. removed and fitted, for example for repair purposes, without laborious dismantling of the machine frame.

If the hydraulic cylinders are in each case designed as double-action cylinders, they can be used not only for applying the roller pressing force but, if acted upon by pressure medium the other way around, also for moving the two rollers apart.

The two rollers can be designed particularly advantageously as loose rollers moveable transversely with respect to the roller nip, as a result of which the two rollers are loaded uniformly and a uniform wear of the roller surfaces is produced. The two rollers can be held by positioning cylinders which are fastened to the machine consoles and which can center the roller nip towards the center of the machine. For the purpose of centering, but also for moving the two rollers independently of each other, there is also the possibility of designing the operating hydraulic cylinders as double piston hydraulic cylinders with two working spaces, which can be acted upon with pressure medium independently of each other, and pistons which act on the respectively opposite bearing housings.

The two bearing housings of one of the two milling rollers can be coupled by their outer sides, which face away from the roller nip, but also via connecting elements, such as, for example, rods, to a machine frame part, such as, for example, consoles, so that this roller then becomes the fixed roller. These rods are situated outside the self-contained system of milling pressing forces and in turn merely prevent the two rollers together with the bearing housings from slipping laterally on their slideways of the machine consoles.

BRIEF DESCRIPTION OF THE DRAWINGS

The invention and further features and advantages thereof are explained in more detail with reference to the exemplary embodiments illustrated diagrammatically in the figures, in which.

DETAILED DESCRIPTION OF THE PREFERRED EMBODIMENTS

Figure 1:
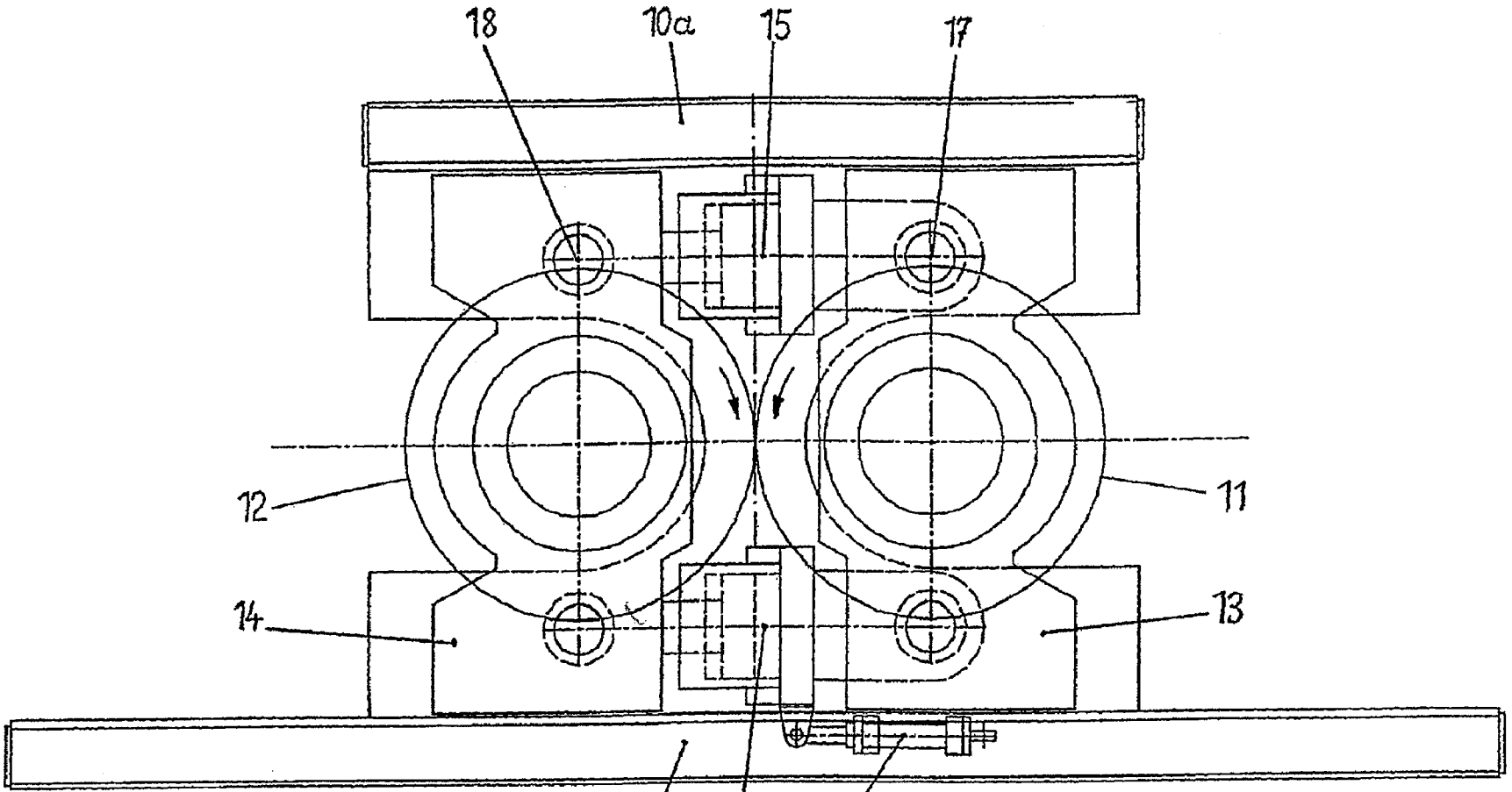
FIG. 1 shows the end view of a first variant of the twin-roller machine according to the invention, such as, for example, a roll press.

The roll press according to FIG. 1 no longer has a self-contained machine frame for absorbing the roller pressing forces but rather the frame essentially comprises just two spaced-apart consoles 10 which are situated transversely with respect to the roller nip and the top sides of which have planar slideways. The two rotatably mounted, counterrotationally driven rollers 11, 12, which are separated from each other by the roller nip, are designed in the exemplary embodiment as rollers moveable transversely with respect to the roller nip. The two rollers 11, 12 are mounted at their two ends in bearing housings 13 and 14, the bottom and top sides of which are mounted on the slideways of the consoles 10, 10*a*.

Figure 3:
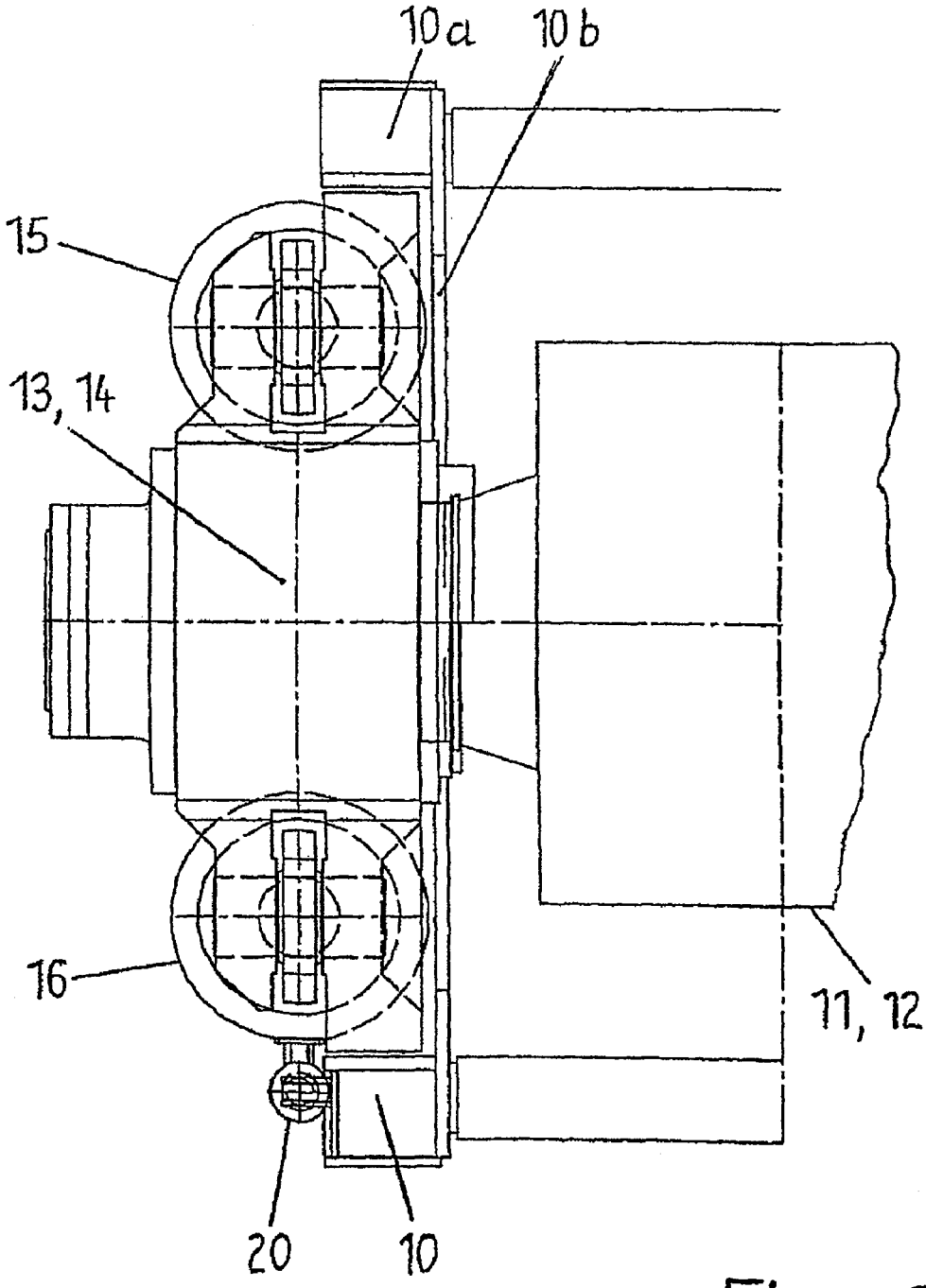
FIG. 3 shows the side view of FIG. 1.

The two rollers 11 and 12, by means of their bearing housings 13 and 14, can slide to and fro in a translatory manner transversely with respect to the roller nip on the slideways of the consoles 10. The upper slideway guide of the bearing housings 13, 14 is indicated by the number 10*a*. The connecting element between upper and lower console 10, 10*a* is indicated in FIG. 3 by the number 10*b*. According to the exemplary embodiment of FIG. 1, the roller pressing force for the compressive loading of the material which is situated in the roller nip and is to be comminuted is applied by a total of four hydraulic cylinders of which, in the end view of FIG. 1, the two hydraulic cylinders 15 and 16 can be seen which connect the mutually opposite front bearing housings 13 and 14 directly to each other. That is to say, as also emerges from FIG. 3, the two ends 17 and 18 of the upper hydraulic cylinder 15 are coupled as articulated bearings, in the same manner as in the case of the lower hydraulic cylinder 16, to or in the respectively mutually opposite bearing housings 13 and 14. Instead of the two hydraulic cylinders 15, 16, just a single, central hydraulic cylinder could also be arranged per roller end side.

According to FIG. 1, the hydraulic cylinders 15, 16 are arranged in such a manner that they act in each case both on the bearing housings 14 of one roller 12 and on the respectively opposite bearing housings 13 of the other roller 11 with a self-contained system of milling pressing forces being formed, so that a heavy machine frame loaded by the roller pressing forces becomes unnecessary. When the hydraulic pulling cylinders 15, 16 are acted upon by pressure medium in opposite directions, i.e. when the said hydraulic pulling cylinders are designed as double-action cylinders, the cylinders may also be used for moving the two rollers apart.

Figure 2:
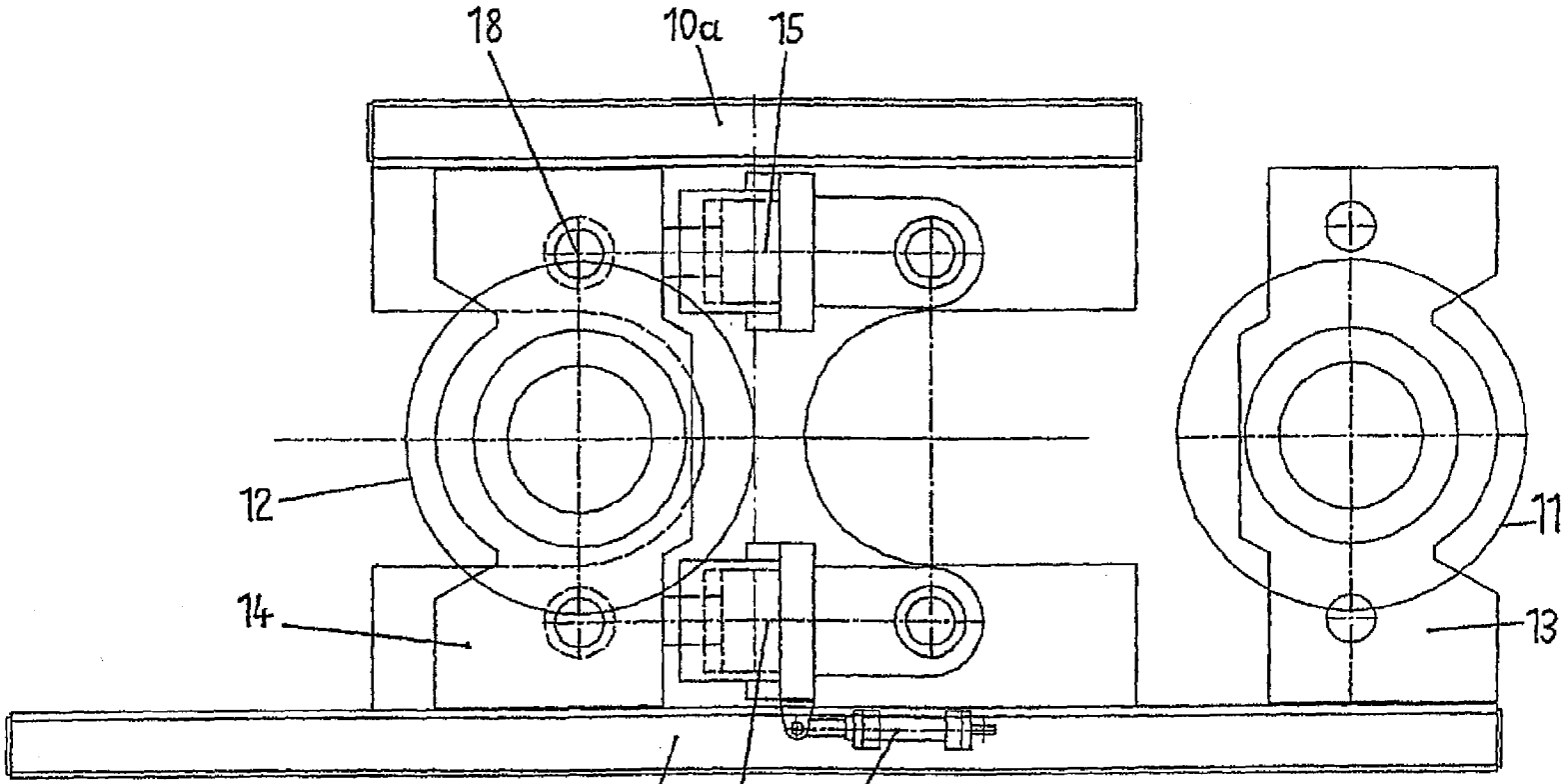
FIG. 2 shows the end view of FIG. 1 with a roller pulled out to the right-hand side.

FIG. 2 shows how, for example, the right cylinder 11 together with bearing housings 13 can be pulled out on the consoles 10 towards the right-hand side without obstruction by a machine frame.

So that the self-contained system of milling pressing forces, which system is formed between the respectively opposite bearing housings 13, 14, cannot slip laterally on the slideways of the consoles 10, the rollers are held by positioning cylinders 20 which are fastened to the machine consoles 10 and act on the cylinder tubes of the hydraulic cylinders 16 or on another suitable component of the system in order to be able to center the system towards the center of the machine by actuation of the positioning cylinders 20, even during operation of the machine. The positioning cylinders 20 taking on a control function may at the same time be hydrodynamic damping components for damping the vibrations and impacts occurring during operation of the machine.

Since the bearing housings 13, 14 are free on the loaded side, the shape of the bearing housings may be designed in such a manner that an optimum distribution of load to the rolling contact bearing installed in the particular bearing housing is ensured.

Figure 4:
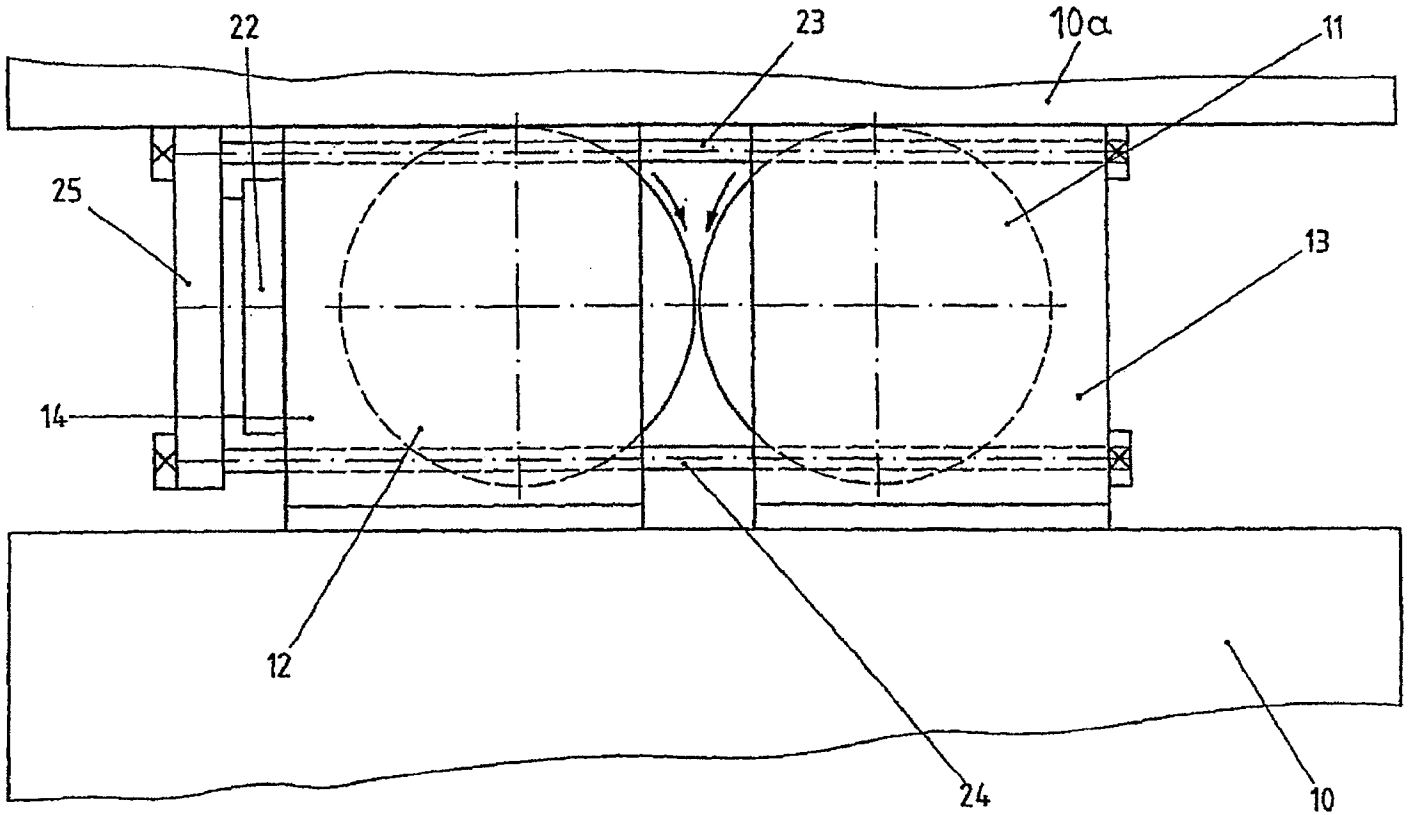
FIG. 4 shows the end view of a second variant of the arrangement of the bearing housings and hydraulic cylinders for applying the roller pressing force.

In the case of the variant of FIG. 4, the hydraulic cylinders are designed as flat pressure cylinders 22 which can be pressed against the bearing housings 14 of one roller 12, on the outer sides thereof that face away from the roller nip, and which transfer their pressing forces via connecting rods 23, 24, which are situated trans-versely with respect to the roller nip, to the respectively opposite bearing housings 13 of the other roller 11. In this case, the flat pressure cylinders 22 are supported in each case on a crossbar 25 which is coupled to the outer ends of the connecting rods 23, 24, the inner ends of which are in turn coupled to the respectively opposite bearing housing 13 of the other roller 11. Also in the case of this variant of the invention, a machine frame which would have to absorb the roller pressing forces is dispensed with.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A twin-roller machine for the pressure treatment of granular material with two rotatably mounted, counterrotationally driven rollers which are separated from each other by a roller nip and of which at least one is designed as a loose roller moveable transversely with respect to the roller nip, the bottom and top sides of the bearing housings being mounted on slideways of machine consoles, with hydraulic cylinders being used for pressing one roller against the opposite roller, the hydraulic cylinders are arranged in such a manner that they act in each case both on the bearing housings of one roller and on the respectively opposite bearing housings of the other roller with a self-contained system of milling pressing forces being formed without a closed machine frame loaded by the radial roller pressing forces, wherein the hydraulic cylinders are pressure cylinders which can be pressed against the bearing housings of one roller, on the outer sides thereof that face away from the roller nip, and which transmit their pressing forces via connecting rods, which are situated transversely with respect to the roller nip, to the respectively opposite bearing housings of the other roller.

2. The twin-roller machine according to claim 1, wherein the hydraulic cylinders are each double-action cylinders and are arranged to be used for moving the two rollers apart.

3. The twin-roller machine according to claim 1, wherein the two rollers are designed as loose rollers moveable transversely with respect to the roller nip.

4. The twin-roller machine according to claim 1, wherein the working hydraulic cylinders are designed as double piston hydraulic cylinders with two working spaces, which can be acted upon with pressure medium independently of each other, and pistons which act on the respectively opposite bearing housings.

5. The twin-roller machine according to claim 1, wherein the bearing housings of one roller as the fixed roller are coupled to a machine frame part via rods.

6. A twin-roller machine for the pressure treatment of granular material with two rotatably mounted, counterrotationally driven rollers which are separated from each other by a roller nip and of which at least one is designed as a loose roller moveable transversely with respect to the roller nip, the bottom and top sides of the bearing housings being mounted on slideways of machine consoles, with hydraulic cylinders being used for pressing one roller against the opposite roller, the hydraulic cylinders are arranged in such a manner that they act in each ease both on the bearing housings of one roller and on the respectively opposite bearing housings of the other roller with a self-contained system of milling pressing forces being formed without a closed machine frame loaded by the radial roller pressing forces wherein the two rollers are held by positioning cylinders which are fastened to the machine consoles and center the roller nip towards the center of the machine.

7. The twin-roller machine according to claim 6, wherein the hydraulic cylinders are pulling cylinders which are arranged transversely with respect to the roller nip between the respectively mutually opposite bearing housings of the rollers.

8. The twin-roller machine according to claim 6, wherein the hydraulic cylinders are each double-action cylinders and are arranged to be used for moving the two rollers apart.

9. A twin-roller machine for the pressure treatment of granular material comprising:

two rotatably mounted, substantially parallel counterrotationally driven rollers separated from each other by a roller nip with at least one of the rollers being arranged as a loose roller moveable transversely with respect to the roller nip, bearing housings containing bearings for mounting the two rollers at each end of the rollers, the bearing housings having bottom and top sides, machine consoles having slideways extending transversely of the rollers upon which the bottom and top sides of the bearing housings are slidably mounted, a plurality of hydraulic cylinders, each arranged to act on the bearing housing of one roller and on the respectively opposite bearing housing of the other roller with a self-contained system of milling pressing forces being formed, avoiding a need for a closed machine frame to support a load of milling pressing forces, wherein the hydraulic cylinders are pressure cylinders arranged to be pressed against the bearing housings of one roller, on outer sides thereof that face away from the roller nip, and which transmit their pressing forces via connecting rods, which are situated transversely with respect to the roller nip and which extend from the pressure cylinders at one end to the respectively opposite bearing housings of the other roller.

10. The twin-roller machine according to claim 9, wherein the hydraulic cylinders are each double-action cylinders and are arranged to also be used for moving the two rollers apart.

11. The twin-roller machine according to claim 9, wherein the two rollers are both arranged as loose rollers moveable transversely with respect to the roller nip.

12. The twin-roller machine according to claim 11, wherein the rollers and hydraulic cylinders form a system, and including positioning cylinders extending between a component of the system and the machine consoles to center the roller nip towards a center of the machine.

13. The twin-roller machine according to claim 9, wherein the working hydraulic cylinders are double piston hydraulic cylinders with two working spaces, which can be acted upon with pressure medium independently of each other, and pistons which act on the respectively opposite bearing housings.

14. The twin-roller machine according to claim 9, wherein one of the rollers is a fixed roller, with the bearing housings of the fixed roller being coupled to the consoles, via rods.

15. The twin-roller machine according to claim 9, wherein ends of the hydraulic cylinders are connected to the bearing housings in an articulated manner.

16. The twin-roller machine according to claim 9, wherein two hydraulic cylinders are arranged at each end of the rollers.

17. The twin-roller machine according to claim 9, wherein one hydraulic cylinder is arranged at each end of the rollers.

18. A twin-roller machine for the pressure treatment of granular material comprising:

two rotatably mounted, substantially parallel counterrotationally driven rollers separated from each other by a roller flip with at least one of the rollers being arranged as a loose roller moveable transversely with respect to the roller nip, bearing housings containing bearings for mounting the two rollers at each end of the rollers, the bearing housings having bottom and top sides, machine consoles having slideways extending transversely of the rollers upon which the bottom and top sides of the bearing housings are slidably mounted, a plurality of hydraulic cylinders, each arranged to act on the bearing housing of one roller and on the respectively opposite bearing housing of the other roller with a self-contained system of milling pressing forces being formed, avoiding a need for a closed machine frame to support a load of milling pressing forces, and positioning cylinders extending between the hydraulic cylinders and the machine consoles to center the roller nip towards a center of the machine.

19. The twin-roller machine according to claim 18, wherein the hydraulic cylinders comprise pulling cylinders arranged transversely with respect to the roller nip between the respectively mutually opposite bearing housings of the rollers.

20. The twin-roller machine according to claim 18, wherein the hydraulic cylinders are each double-action cylinders and are arranged to also be used for moving the two rollers apart.

* * * * *